United States Patent [19]

Smith

[11] Patent Number: 4,768,983

[45] Date of Patent: Sep. 6, 1988

[54] POWER DRIVE ASSEMBLY FOR OUTBOARD ENGINES

[76] Inventor: Allen J. Smith, P.O. Box 947, Springfield, Mo. 65803

[21] Appl. No.: 21,344

[22] Filed: Mar. 3, 1987

[51] Int. Cl.[4] ..... B63H 21/30

[52] U.S. Cl. ..... 440/111; 440/75; 440/88; 114/270

[58] Field of Search ..... 440/49, 52, 64, 75, 440/76, 77, 88, 89, 111, 112, 113, 900; 114/270

[56] References Cited

U.S. PATENT DOCUMENTS 3,010,422 11/1961 Brakensiek ..... 440/88
3,170,434 2/1965 Ewing ..... 440/75

FOREIGN PATENT DOCUMENTS 260863 5/1963 Canada ..... 440/88

*Primary Examiner*—Sherman D. Basinger
*Attorney, Agent, or Firm*—Dowell & Dowell

[57] ABSTRACT

Marine power drive assemblies for converting conventional outboard engines to operate with inboard engine characteristics having horizontal drives and wherein the power heads of the conventional engines are modified by replacing the conventional adapter plates for the exhaust, water inlet and discharge for supplying coolant to the engine with modified adapter plates which both align and support a tuned exhaust expansion assembly, a gear box assembly and an engine mounting base or frame which retains the engine power head, modified adapter plate, gear box and exhaust assemblies in one combined assembly for ease of installation and/or removal from the hull of a boat. The power output of the gear box assemblies are oriented generally horizontally and are selectively connected to an appropriate propulsion source. In the preferred embodiment, the thrust source is a jet propulsion pump which is supported by the hull for power output in a substantially horizontal plane, thereby the conventional outboard engine with vertical drive is converted to a vertical engine having horizontal propulsion drive.

25 Claims, 7 Drawing Sheets

Fig. 9
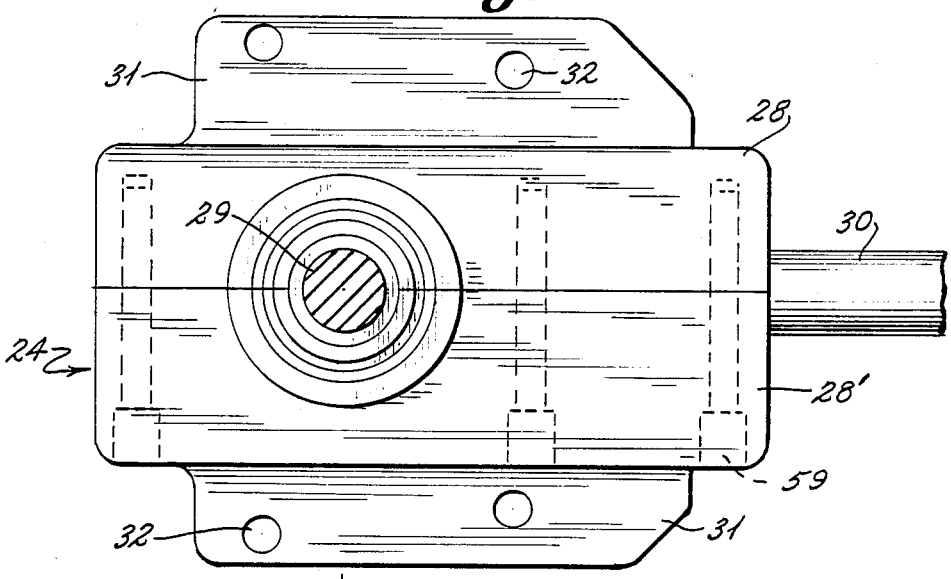
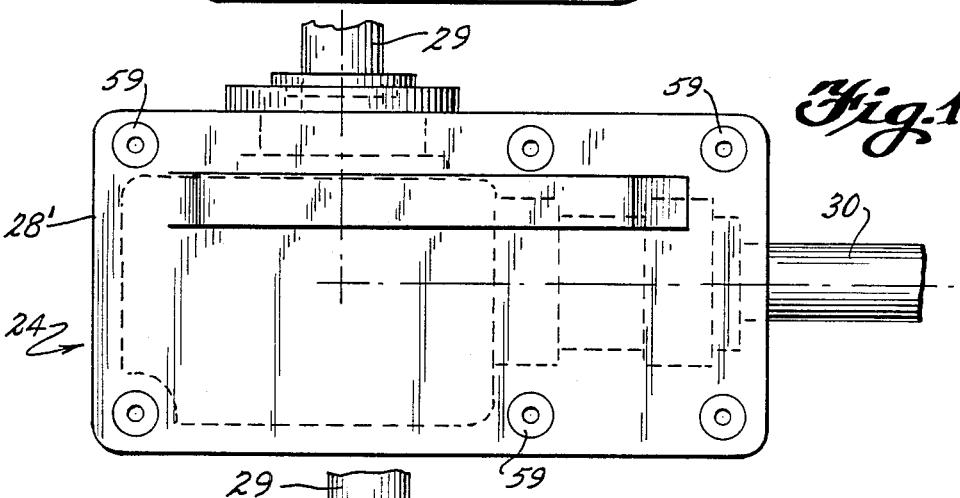
Fig. 10
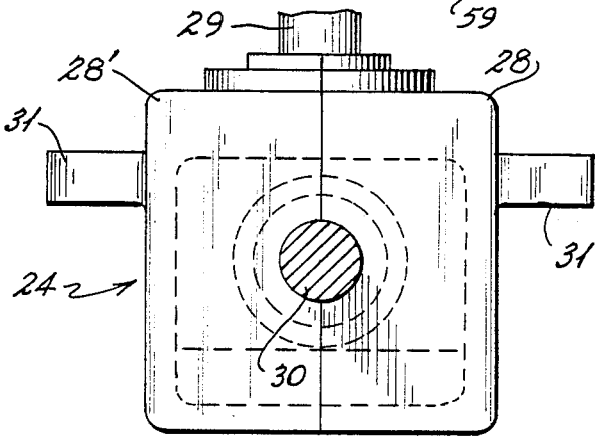
Fig. 11

POWER DRIVE ASSEMBLY FOR OUTBOARD ENGINES

BACKGROUND OF THE INVENTION

1. Field of the Invention

This invention is generally directed to engines or power drive assemblies for small marine boats including water recreational vehicles, emergency and military supply boats and other water craft utilizing outboard engines ranging in size up to 375 horsepower or more and more particularly to power drive systems which modify outboard engines to operate with an inboard capability by converting the conventional vertical drive to an in-line horizontal drive In the preferred embodiment, conventional outboard engines having propeller type propulsion units are converted to jet or fluid propulsion systems by replacing the standard power head adapter plate with a combination adapter and mounting plate which will provided the proper interface of the power head with a tuned exhaust expansion assembly and a gear box assembly which will create a horizontal drive extending from the engine to the rear of the marine craft. Although the power drive assembly of the present invention may be utilized with various types of marine craft, the invention is disclosed as being adapted to a recreational boat wherein the outboard motor is mounted within the boat in such a manner that the entire drive train and engine are carried by a common support base or frame.

2. History of the Art

The small water craft industry has historically utilized both inboard and outboard engines to provide power for propulsion. Until recent years, propulsion was primarily established by means of impellers driven by the power source. In conventional outboard engines, the propellers are commonly mounted to the vertical drive shaft with most innovation in technology being directed toward modifying the drive train and changing impeller design and gearing. Generally, outboard engines are utilized on small boats and have horsepower ratings varying anywhere from approximately 2–375 or more horsepower.

As the small craft industry began to develop new designs for recreational and other type of water vehicles such as JET SKIS and the like, conventional inboard engines were adapted to be utilized as the power source for the propulsion systems for such vehicles. In other conventional recreational water craft, use has been made of outboard engines which are mounted to the transom of the craft in such a manner that the engines may be swiveled to change the direction of the impeller blade to steer the craft or boat. As new power boats or recreational vehicles have gained acceptance with the boating public, new types of propulsion systems have been developed to improve the safety, speed, handling and overall performance and reliability of such boats. One such propulsion system incorporates the use of jet pumps to create a drive thrust.

The development of jet pump propulsion units has enabled recreational boats and the like to h=driven by water thrust as opposed to mechanical propeller drive. Such water jet propulsion units have the advantage of not having any exposed rotating propeller blades associated with the propulsion system. Unfortunately, such jet propulsion units have required the redesign of conventional power and drive systems in order to make the use of such propulsion units possible in small craft or recreational boats.

SUMMARY OF THE INVENTION

This invention is directed to a marine power drive assembly which may be utilized for converting the power head mounting assembly of conventional outboard engines into horizontal in-line drive systems which can be used to power jet pump or other propulsion systems. The power drive assembly includes a modified adapter and mounting plate which is installed in place of the conventional or existing adapter plate associated with the engine block of an outboard engine and which adapter and mounting plate provide a water cooling circuit for the engine and exhaust assembly and aligns the exhaust outlet and power or drive output of the engine crankshaft with specially designed exhaust and gear box assemblies. The gear box assembly is carried or mounted directly to the modified adapter and mounting plate so as to be in proper alignment for engagement with the power output of the crankshaft of the engine. The gear box includes a power output which extends generally in horizontal alignment with the boat thereby converting the vertical drive of the engine to a horizontal or in-line drive wherein the output of the gear box is in general alignment with a propulsion source which is drivingly connected thereto. A tuned exhaust expansion assembly is also mounted to the modified adapter and mounting plate so as to enable exhaust from the engine to be properly discharged while being cooled as it is directed generally rearwardly of the water craft. The propulsion unit, which may vary but is shown in the preferred embodiment as a jet pump, is mounted to an engine base or mounting frame which is directly secured to the boat hull and which base frame also is secured to the adapter and mounting plate so as to thereby mount the engine power head to the boat. In use, the modified adapter and mounting plates will function both as the conventional adapter plates for the bottom of the engine blocks and also as supports for the modified drive and exhaust expansion assemblies. The shape of the adapter plates will be somewhat modified depending upon the type, size and manufacturer of an engine. Likewise, the exact configuration of the exhaust assemblies and engine mounting frames may also be varied depending upon the specifications of a particular engine. The gear box assembly is also designed so that the gearing ratios and drive input and outputs can be changed as necessary to accomodate specific engines and power output requirements.

The power drive assemblies of the present invention will be described within the application as they are associated primarily with boats of the type which carry one, two or more persons on a seat or platform and wherein the power head of an outboard engine is used to provide power for the boats' propulsion systems. It should be understood, however, that the invention could be used to modify any type of outboard motor in any water craft or vehicle. That is, the power drive assembly of the present invention may be utilized to convert conventional outboard engines to engines which operate in an outboard-inboard manner where the conventional vertical drive is converted into a horizontal drive which may be selectively connected with any number of propulsion systems. The term outboard-inboard is descriptive of the concept of the present invention wherein an outboard engine is mounted inside a boat and is utilized to drive or power horizontally an internal, external or other propulsion system.

The tuned expansion exhaust assembly of the present invention is also uniquely designed to both functionally and operationally cooperate and interface with the exhaust system of conventional outboard engine power heads. The exhaust expansion assembly not only provides for proper muffling of the engine exhaust but also cools exhaust gas emissions. The assembly is adapted to receive cooling water directly from the engine cooling system which water passes through a jacketed exhaust and muffler chamber to cool gases passing therethrough. The cooling water is subsequently introduced directly into the exhaust gas to provide additional cooling through contraction of the exhaust gases.

It is the primary object of the present invention to provide a power drive assembly for recreational and other water craft of the type which conventionally use smaller outboard engines as a power source wherein the power source may be adapted to provide an alternate drive system to an in-line propulsion unit without changing the characteristics of an existing engine's power head.

It is also an object of the present invention to provide power drive assemblies for outboard engines used with small boats wherein the outboard engines may be converted from vertical drives with propeller propulsion to horizontal drives with jet, propeller or other types of propulsion without major modification to either the engine's power heads or to the boats.

It is a further object of the present invention to provide a marine power drive assembly which may be utilized to convert outboard engines to function in an outboard-inboard capacity by enabling such engines to be mounted within a boat and power a horizontal drive train to which any conventional type of propulsion unit may be drivingly connected.

It is a further object of the present invention to enable a propeller driven water craft having an outboard motor ranging in power from 2–375 horsepower to be modified to be propelled by a jet pump without modification to the engine's power head.

It is another object of the present invention to increase the safety of various recreational and other types of water vehicles by enabling conventional propeller driven water craft to be powered by alternate propulsion systems including jet pumps.

It is another object of the present invention to provide an alternate propulsion system for conventionally powered outboard motorboats whereby such boats may be operated utilizing jet pump thrusters for propulsion.

It is also an object of the present invention to provide tuned exhaust expansion assemblies for outboard engines which are utilized in an inboard capacity wherein the exhaust from such engines is not only muffled but is cooled both indirectly by conduction and convection and directly by fluid injection with any backdraw of liquid being prevented by the mounting relationship of the exhaust assemblies with respect to the engines.

Another object of the present invention is to provide a modified gear box assembly which may be utilized to convert the vertical drive of conventional outboard motors to an in-line horizontal drive wherein the gear ratio of the gear box may be selectively changed to obtain the optimum power output to the in-line drive system.

BRIEF DESCRIPTION OF THE DRAWINGS

FIG. 9 is a top plan view of the gear box utilized with the. present invention.

FIG. 10 is a right side elevational view taken from the front of the boat of FIG. 1 of the gear box used with the present invention.

FIG. 11 is a rear view (as seen from the rear of the boat of FIG. 1) of the gear box shown in FIG. 9.

DESCRIPTION OF THE PREFERRED EMBODIMENT

Figure 3:
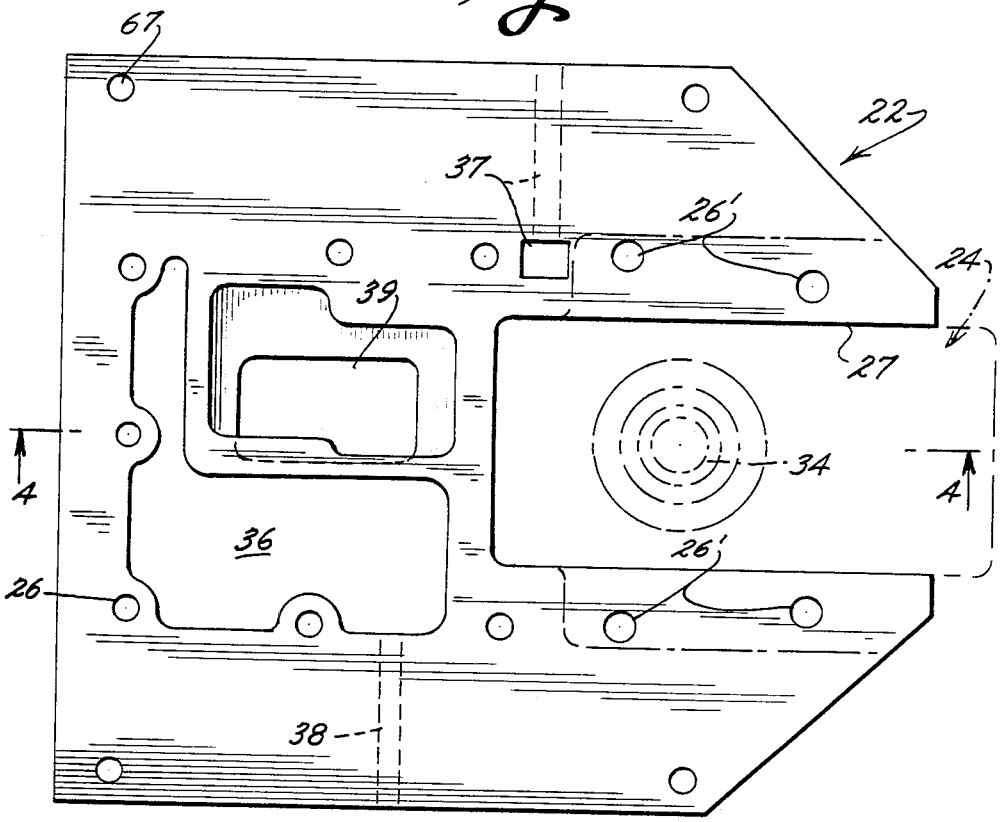
FIG. 3 is a top plan view of one form of modified adapter and mounting plate used in accordance with the present invention to support the drive train and tuned exhaust expansion assembly with respect to a conventional outboard engine.
Figure 4:
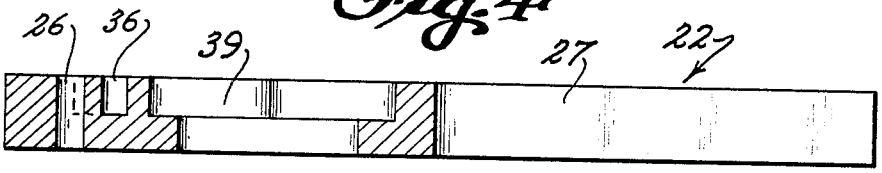
FIG. 4 is a cross sectional view taken along lines 4—4 of FIG. 3.
Figure 5:
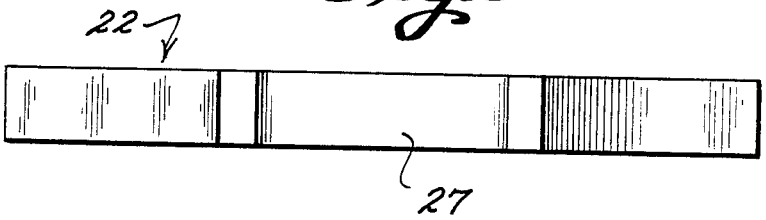
FIG. 5 is a left side view of the modified adapter and mounting plate of FIG. 3.
Figure 6:
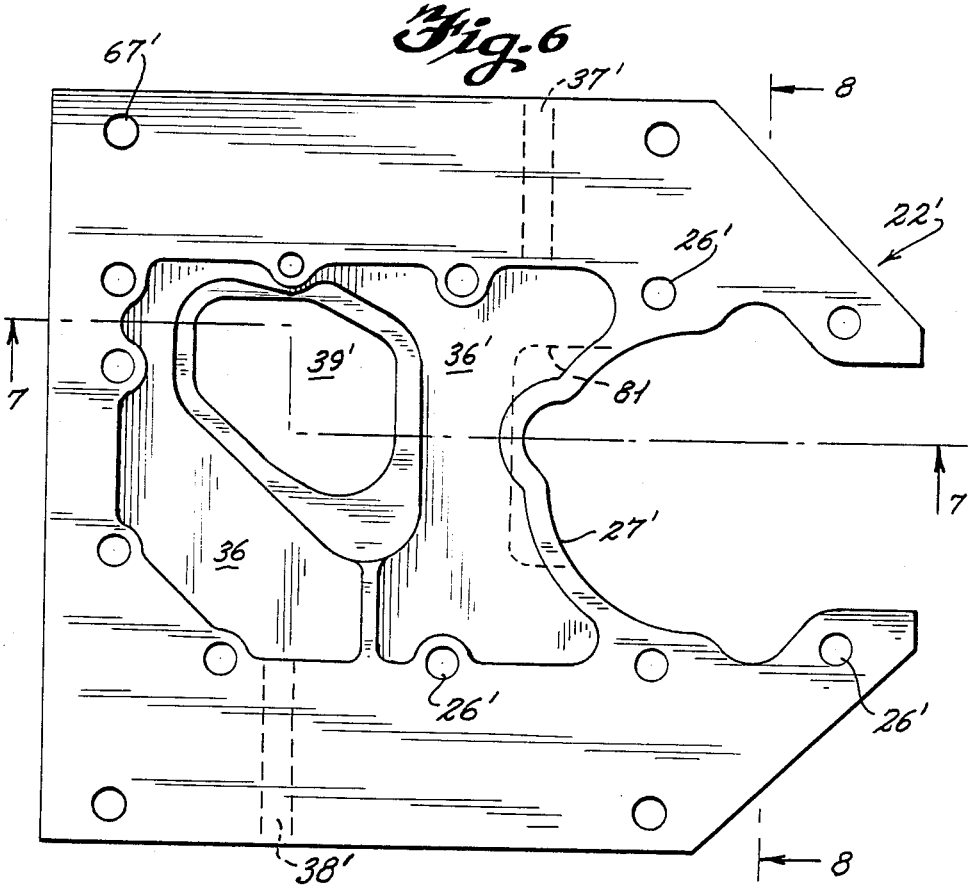
FIG. 6 is a top plan view of a second modified adapter and mounting plate as used in accordance with the present invention.
Figure 7:
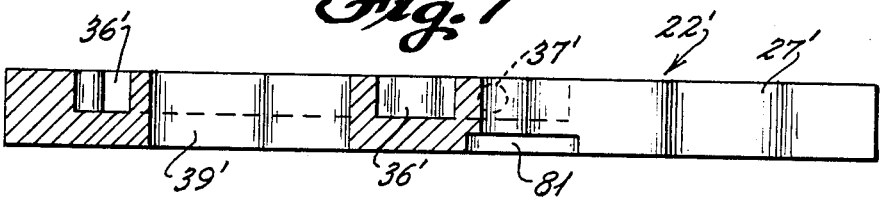
FIG. 7 is a left side view taken with respect to the adapter and mounting plate of FIG. 6.
Figure 8:
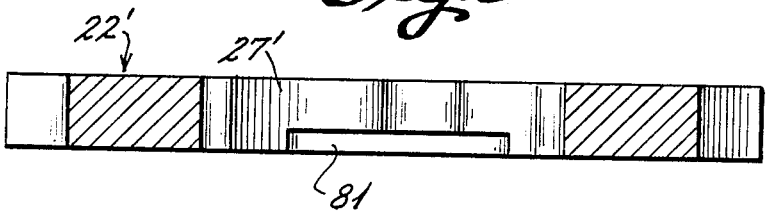
FIG. 8 is a cross sectional view taken along lines 8—8 of FIG. 6.

With continued reference to the drawings, the marine power drive system 20 of the present invention is shown as it is utilized with a conventional outboard engine E. The outboard engine is generally of the type which is rated between 10 and 150 horsepower but may be in the range of 2–375 horsepower. By way of example, the power drive assembly of the present invention will be described as it has been used for adapting a 50 horsepower OMC engine utilizing the modified adapter and mounting plate shown in FIGS. 3 and 5 and also with respect to a MERCURY 50 horsepower engine utilizing the modified adapter and mounting plate which is shown in FIGS. 6–8. It should be noted that the adapter and mounting plates shown in the drawings are slightly modified with respect to one another in order to correctly interface with the exact internal working components of each engine and to simultaneously function in a manner similar to the conventional or standard adapter plate for the engine power head. Similar changes may be made to the adapter and mounting plates, as will be discussed hereinafter, for purposes of interfacing the invention with other makes and sizes of engines.

Figure 1:
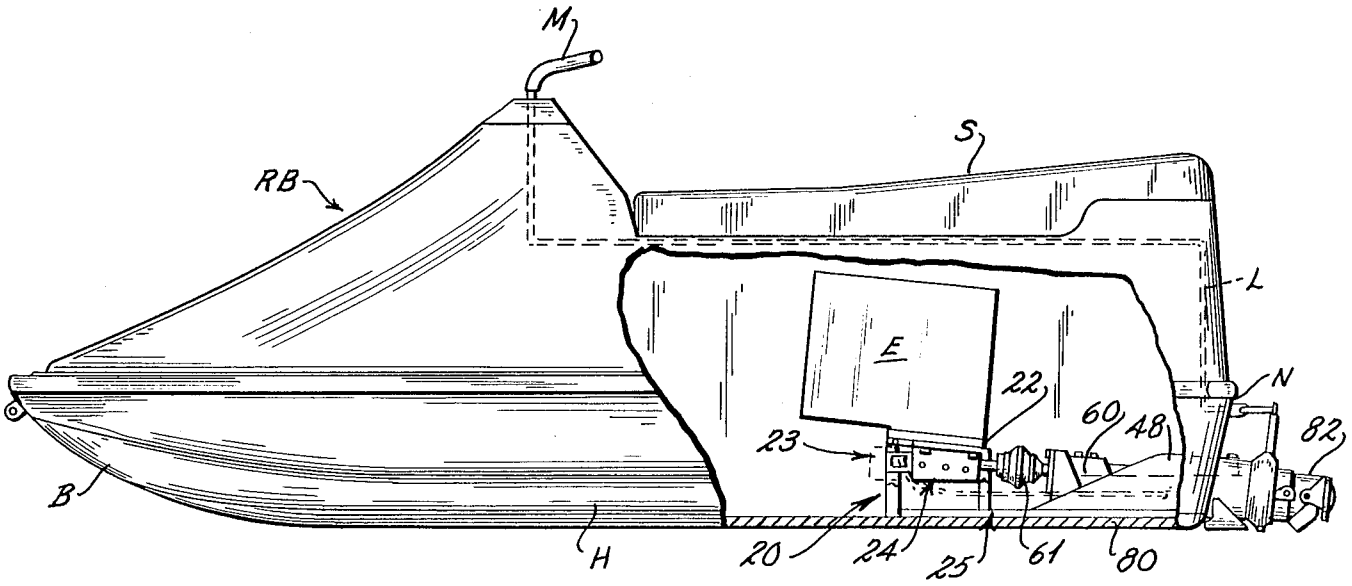
FIG. 1 is a side view having portions broken away of a recreational boat showing a conventional outboard engine power head having the power drive assembly of the present invention being drivingly connected thereto.

With reference to FIG. 1 of the drawings, the power drive system of the present invention is shown as being used with an engine power head E which is mounted within the body of a recreational boat RB. The engine is shown as being mounted generally centrally of the boat and beneath the seat S which is straddled by the driver. A steering mechanism M is shown as being mounted through the housing of the boat and is connected through appropriate linkage L to the propulsion system so that the nozzle thereof is directly pivoted in response to the movement of the steering mechanism as will be described in greater detail hereinafter. As shown, the engine is mounted generally centrally of the boat between the bow B and the stern N and positioned so that the bottom portion of the engine block is generally above the water line within the hull H.

Figure 2:
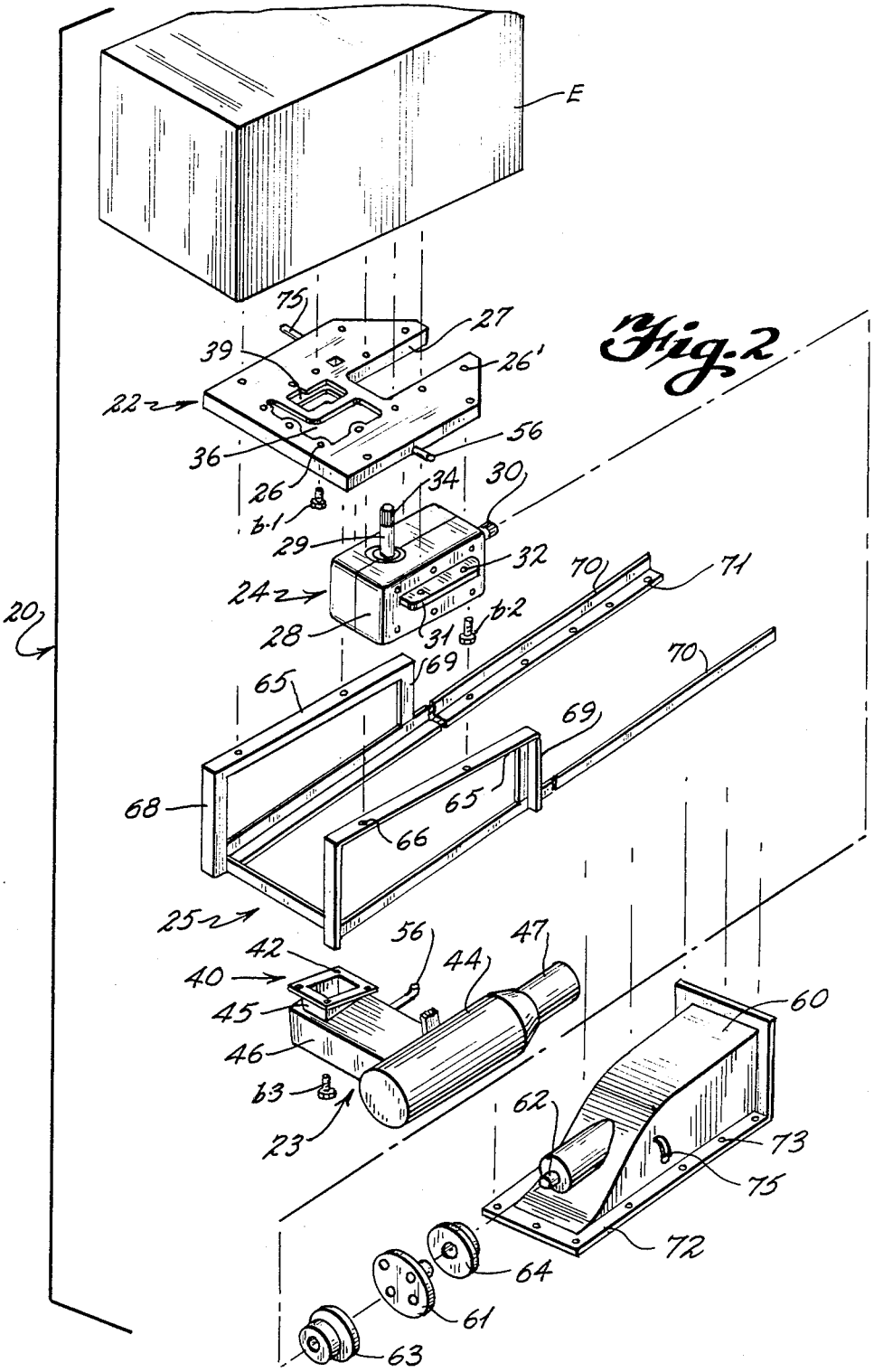
FIG. 2 is an assembly view showing the components of the power drive system of the present invention as they are aligned for mounting to the bottom of the power head of a conventional outboard engine.

In preparation for modification of the vertical drive and propeller propulsion associated with conventional outboard engines the power head E is removed from the vertical drive train and housing. Thereafter, a specially designed or modified adapter and mounting plate, such as the one identified at 22 in FIG. 2, is mounted to the bottom of the power head in place of the conventional adapter plate. The specific details of the mounting plate will vary depending upon the make and model of each outboard motor. The specifics of two such mounting plates will be disclosed within the body of this application with specific references to FIGS. 3–5 and 6–8. The function of the modified adapter and mounting plates are to both seal the bottom of the engine block or power head as well as to provide appropriate alignment and support for a tuned exhaust expansion assembly 23, a gear box assembly 24 and an engine support and power drive alignment mounting bracket or base 25.

With specific reference to FIGS. 2, 3, 12 and 13 of the drawings, the modified adapter and mounting plate 22 is secured in place to the bottom of the engine block or power head E by a plurality of bolts b-1 which extend through a plurality of openings 26 which are aligned with corresponding previously existing openings in the power head. Although not shown in the drawings, a gasket material will be placed between the engine and the adapter and mounting plate 22 so as to insure a fluid tight seal therebetween. The plate 22 includes a U-shaped slotted opening 27 which is of a size to receive the housing 28 of the gear box assembly 24. The gear box assembly is disclosed as having a power input shaft 29 extending from the upper portion thereof and a power output shaft 30 extending from the rear wall thereof. Mounting flanges 31 are provided along each of the side walls of the gear box and which flanges have pairs of spaced openings 32 therein which are aligned with openings 26' adjacent the opening 27 in the adapter and mounting plate. After the modified adapter and mounting plate has been placed in position relative to the engine, the gear box is raised through the slotted opening 27 so that the splined end 34 of the shaft engages with the drive output of the engine crankshaft. In this position, the flanges 31 of the gear box will abut the lower wall of the adapter and mounting plate with the openings 32 being in alignment with the openings 26' in the plate. Appropriate bolts b-2 are thereafter placed through the aligned openings to secure the gear box to the adapter and mounting plate and the engine block.

The modified adapter and mounting plate not only functions to mount the components of the invention with respect to the engine but also provides a reservoir for circulating coolant or water to the engine. Each adapter and mounting plate includes a recessed water cooling reservoir or area 36 which is formed in the upper portion thereof. Each reservoir is aligned with the water cooling system of the engine. The shape of such water cooling areas will therefore change depending upon the make and model of engine to which the adapter and mounting plate is being secured. In order to supply water to the engine, a fluid inlet channel 37 and a fluid outlet channel 38 are made intermediate the upper and lower surfaces of the adapter and mounting plate so as to communicate with the recessed water circulation reservoirs 36 formed therein. Water will be supplied to the reservoir 36 through the inlet 37 and cycled through the engine and exhausted through the outlet channel 38 in a manner which will be described hereinafter in greater detail.

Figure 12:
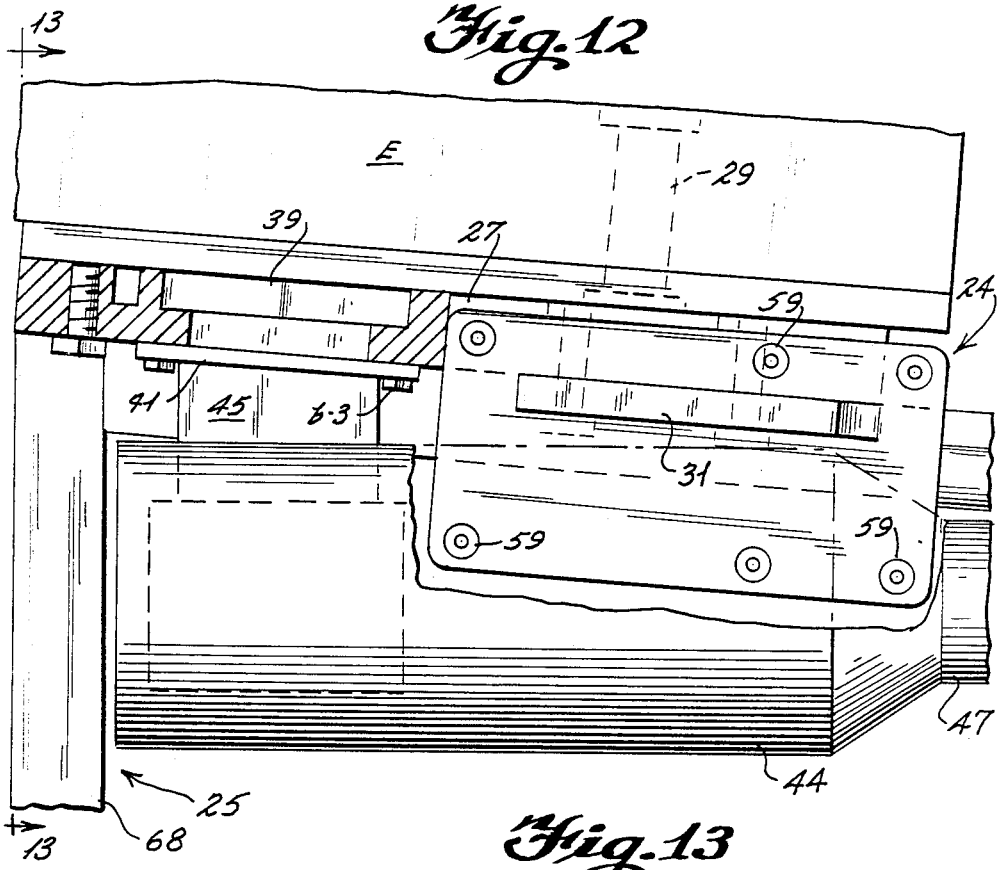
FIG. 12 is an enlarged view showing the alignment between one of the adapter and mounting plates of the present invention and the tuned exhaust expansion and gear box assemblies.
Figure 13:
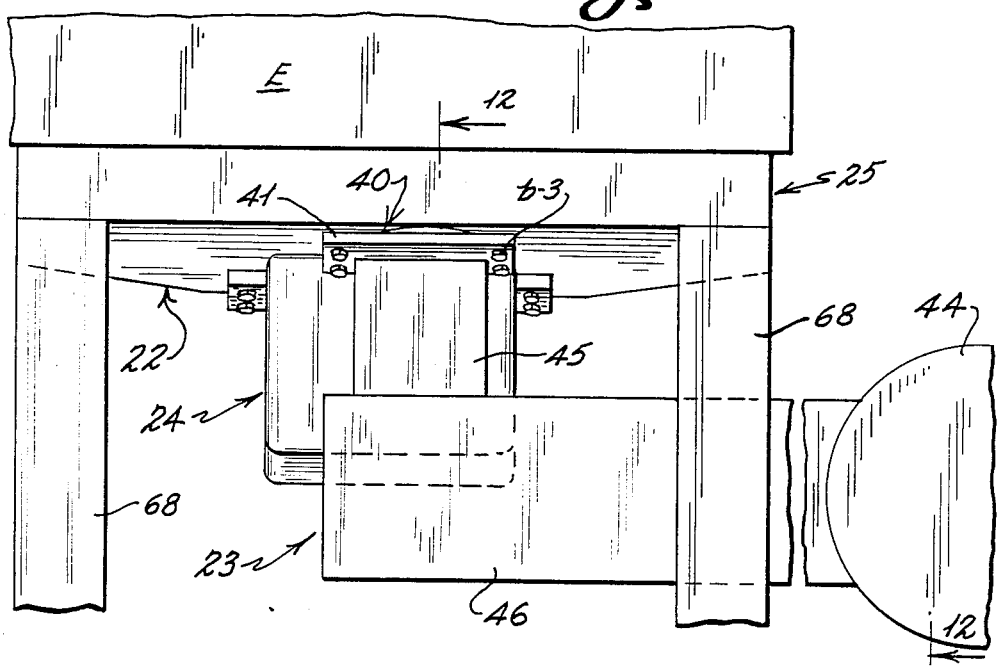
FIG. 13 is a view taken along lines 13—13 of FIG. 12.
Figure 14:
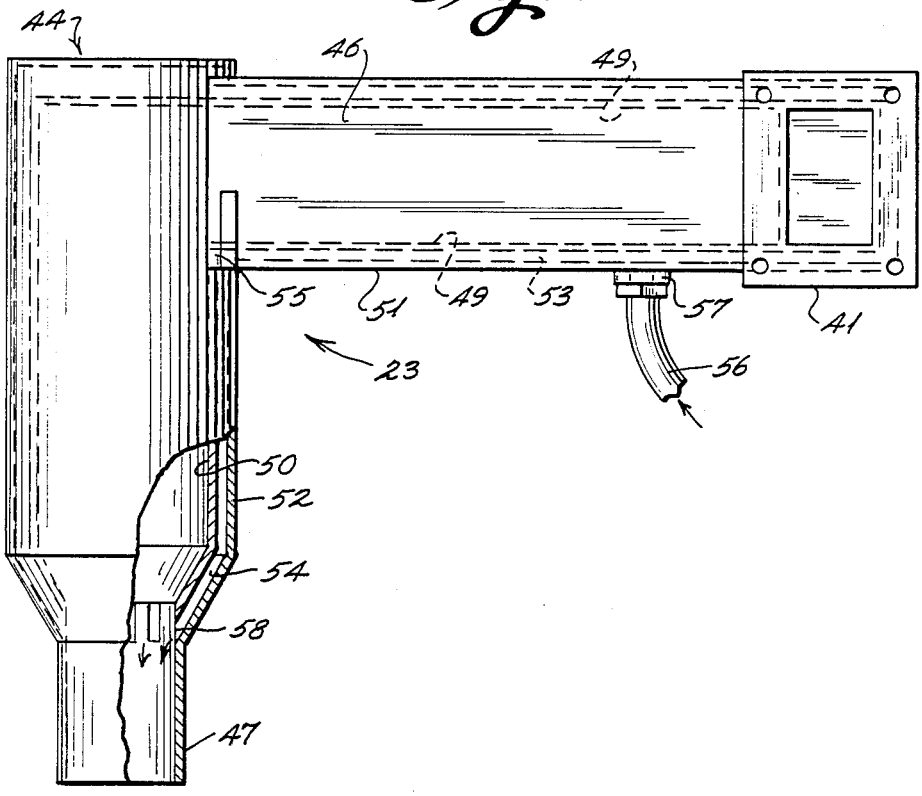
FIG. 14 is a top plan view of the tuned exhaust expansion assembly of the present invention.
Figure 15:
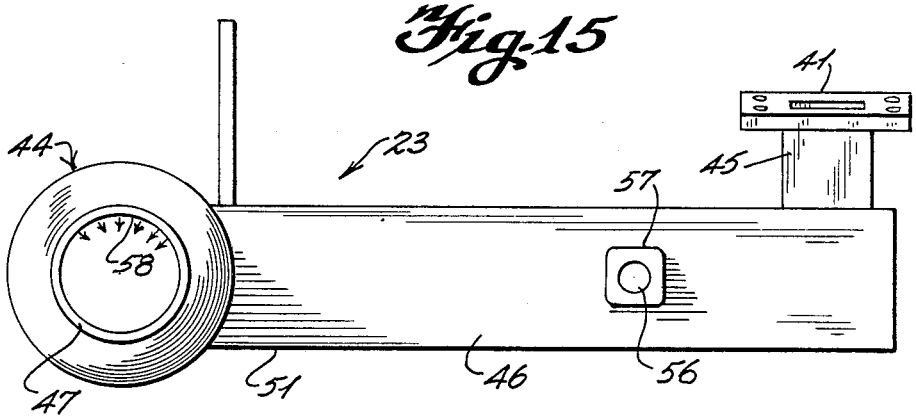
FIG. 15 is a rear view of the exhaust assembly of FIG. 14 as viewed from the rear of the boat.

The adapter and mounting plate 22 also aligns the exhaust system of the engine with a specially tuned exhaust expansion assembly 23. The plate includes an exhaust opening 39 which is aligned with the engine exhaust and may be offset from the upper to the lower surface of the plate. The exhaust expansion assembly 23 includes a mounting portion 40 having an upper generally rectangular flange 41 which abuts the lower surface of the adapter and mounting plate in surrounding alignment with the exhaust opening 39. The flange 41 is provided with a plurality of openings 42 through which bolts b-3 may be extended to engage with aligned openings which are provided in the lower surface of the adapter and mounting plate. As shown in the drawings, the upper flange 41 of the mounting portion 40 of the exhaust expansion assembly is inclined with respect to the muffler 44 of the system by way of a tapered exhaust duct 45 which communicates through a secondary or connector duct 46 with the muffler 44. In this manner, with the flange 41 secured in airtight relationship with the bottom of the adapter and mounting plate 22, the muffler 44 and exhaust pipe section 47 will be oriented at a slight downward angle toward the stern of the boat as shown in FIGS. 12 and 13. The connector exhaust duct 46 also offsets the muffler 44 so that the exhaust system does not interfere with any of the other portions of the modified drive train of the power drive assembly. The exhaust assembly further includes an exhaust tail pipe 48 which extends outwardly through the stern of the boat so as to conduct the exhaust to the rear thereof With specific reference to FIGS. 14 and 15, the tuned exhaust expansion assembly 23 is specially designed to cool the exhaust gases before the gases are discharged from the tail pipe 48. Both the exhaust connector duct 46 and the muffler 44 are constructed having a double wall structure having inner walls 49 and 50 and outer walls 51 and 52, respectively. The walls create continuous fluid channels or fluid jackets 53 and 54 around each of the inner walls of the connector duct and muffler. The fluid jackets communicate with one another as shown at 55. Cooling water is supplied from the engine cooling system discharge 38 which is formed in the adapter and mounting plate 22 by way of a discharge conduit 56 and through inlet 57 into the connector duct 46. Therefore, the engines cooling system discharges directly through the exhaust expansion assembly.

After the cooling liquid has passed through fluid jackets 53 and 54, the coolant will be sprayed directly into the exhaust gas passing from the muffler through a plurality of equally spaced openings 58 which are located in the upper third of the innermost end of the exhaust pipe 47. As the water under pressure enters the exhaust, the water will cause the exhaust gases to be contracted further cooling the gases as they pass through the tail pipe 48. It has been found that during normal operation, the exhaust gases are cooled from temperatures of approximately 1250° to 1300° F. to 160° F. as the gases pass through the tuned exhaust expansion assembly 23 thereby reducing the build up of heat within the engine compartment of the boat and also reducing the risk of injury from hot exhaust gases being discharged from the tail pipe assembly. In addition to the foregoing and as previously discussed, the exhaust expansion assembly 23 is mounted at an incline so that the exhaust pipe 47 extends downwardly or is slanted toward the stern of the boat. This mounting arrangement will insure that there will be no backdraw of water into the engine exhaust system as all water within the assembly will tend to flow by gravity outwardly of the tail pipe.

After the gear box and exhaust expansion assemblies have been installed to the adapter and mounting plate 22, the engine's power output will be effectively converted to a horizontal drive through the L-shaped gearing achieved within the gear box. The gear box is shown in greater detail in FIGS. 9–11. The gear box generally includes a split housing having half sections 28 and 28' which are joined by a plurality of bolts 59 which extend through aligned openings in each of the housing sections. The input shaft 29 of each gear box is designed to cooperatively engage or match with the output of the crankshaft of the conventional engine. The length of the shaft may be varied depending upon the type and size of engine to which the box is mounted. The power input shaft is mounted within conventional roller bearings which are aligned with thrust bearings and appropriate washers and connected at its innermost end with a drive gear (not shown). The drive gear meshes in a spiral beveled arrangement with a driven gear which is carried by the inner end of the drive output shaft 30. The output shaft is provided with appropriate roller bearings and seals which rotatably support the output shaft with respect to the gear box housing. Due to the split housing design, whenever it is necessary to repair the gears or if it is desired to change the gearing ratio, the housing sections may be easily disassembled to thereby permit access to the gearing elements.

As previously discussed, an advantage of the present invention is that a conventional outboard engine having a propeller drive may be easily converted to a horizontal drive in which a jet propulsion or other type of propulsion or thrust source may be drivingly coupled to the engine. With particular reference to FIGS. 1 and 2, a jet propulsion pump 60, which may be of any design, is selectively coupled through flexible coupling elements 61 to the output shaft 30 of the gear box. The flexible coupling also is connected directly to the input shaft 62 of the jet pump. The flexible coupling assembly generally includes a pair of locking collars 63 and 64 which are selectively receivable along the threaded ends of the output shaft 30 and input shaft 62 of the gear box and jet pump, respectively. The jet pump must be mounted in fixed relationship and in line with the output shaft 30 of the gear box.

The jet pump is supported in alignment with the gear box output shaft and positioned at the proper level with respect to the water line adjacent the stern of the boat by an engine mounting bracket or base assembly 25 which is bolted to the boat hull. The mounting bracket or base 25 includes a pair of side frames 65 having openings 66 through the upper portion thereof which are aligned with openings 67 in the adapter and mounting plate 22. Appropriate bolts (not shown) are extended through the aligned openings 66 and 67 in order to secure the adapter and mounting plate to the bracket 25 to thereby secure the engine within the engine compartment of the boat. Each of the mounting bracket side frames includes forward vertical supports 68 which are taller than the rearward vertical supports 69. Each of the side frames are connected to outwardly extending angle brackets 70 which have a plurality of openings 71 in spaced relationship along the length thereof. The pump 60 is mounted within a mounting frame 72 having openings 73. The frame 72 is selectively aligned and secured to the brackets 70 with bolts extending through the aligned openings 71 and 73. Due to the slope created by the differential heights of the front and rear vertical supports 68 and 69, respectively, the brackets 70 will be angled away from the engine E at a slope generally equal to the angle at which the output shaft 30 of the gear box is oriented with respect to the propulsion system or jet pump.

As previously discussed, each of the adapter and mounting plates includes a coolant inlet passage 37 and a coolant discharge passage 38 through which water is supplied via water inlet line 75 and is discharged via line 56. The inlet line extends through the vortex side of the pump 60. During the operation of the pump, water will be drawn upwardly into the engine through the inlet line 75 and through passage 37 then discharged to the exhaust expansion assembly 23 through the passage 38 and discharge line 56.

With particular reference to FIG. 1, it should be noted that once the propulsion system of the present invention is installed within the boat, the system will be generally horizontally arranged at a slight downward angle from the engine toward the stern of the boat. The angle should be sufficient that the pump is oriented so as to receive water through the intake portion thereof generally designated at 80. The positioning and in-line relationship of the component parts creates greater stability of the boat than was possible with the conventional propeller drives, and also increases the maneuverability of the boat.

As previously mentioned, the modified adapter and mounting plates of the present invention may be changed depending upon the make and model of engine which is to be converted to the horizontal drive disclosed. The embodiment discussed in the preferred embodiment disclosed an adapter and mounting plate specifically designed for an OMC engine. With reference to FIGS. 6–8 of the drawings, a modified adapter and mounting plate 22' specifically designed for a 50 horsepower MERCURY engine is disclosed in detail.

The modified adapter and mounting plate 22' is disclosed as having an opening 27' through which the input shaft 29 of the gear box is centrally oriented. In order to provide clearance for the rectangularly shaped housing 28 of the gear box 24, an undercut portion 81 is shown as being made relative to the opening 27'. The undercut will allow the gear box to be securely anchored in position with the input shaft 29 extending upwardly through the central portion of opening 27'. The plate 22' also includes a plurality of openings 26 through which mounting bolts will be extended after appropriate gasket material is placed between the upper surface of the plate and the lower surface of the engine block. As with the adapter and mounting plate discussed above with respect to the previous embodiment, the plate 22' also provides a water cooling jacket or reservoir for the engine. In this regard, a water reservoir or recess area 36' is provided within the upper face of the mounting plate so as to communicate with the water cooling system of the engine. To introduce cooling water to the engine, a fluid inlet channel 37' and an outlet channel 38' are provided intermediate the upper and lower surfaces of the plate so as to communicate with the recessed area 36'. An exhaust opening 39' is also provided through the mounting plate and appropriate holes are provided on the lower surface of the plate so as to receive bolts extending through the flange 41 of the exhaust assembly 23. In a like manner, openings are also provided at the bottom of the plate for receiving bolts which extend through the flanges 31 on either side of the gear box housing. An additional series of openings is also provided which correspond to openings 67 in the plate 22 which openings are aligned with the openings 66 in the bracket assembly 25.

As previously discussed, the power drive assembly of the present invention is designed to permit conventional outboard engines to be converted to horizontal drive engines which can be used with varying propulsion units or sources. In the preferred embodiment of the specification, the horizontal drive has been connected directly to a jet pump in order to obtain the benefits of increased safety and increased maneuverability within the environment of a water recreational vehicle or boat. Not only does the use of the jet pump offer greater drive flexibility in the system disclosed, but it also provides increased efficiency in steering and responsiveness to engine speed. It should be noted, however, that the propulsion system is not confined to use with recreational boats alone and that the system or assembly may be adapted for use with any type of boat having an outboard engine wherein the drive is to be converted to a horizontal orientation so as to enable the engine to power alternate types of propulsion or thrust producing units.

In the use of the power drive assembly of the present invention, the power head is removed from the conventional vertical drive components, housing and propeller drive shaft of an outboard motor. Thereafter, the existing adapter plate is replaced with a modified adapter and mounting plate which is chosen so as to align with the exhaust and drive output of the engine and to provide aligned mounting holes by way which the adapter and mounting plate may be secured to the engine block through the bolt holes already provided therein. The adapter and mounting plate is secured utilizing proper gasketing materials and will provide support for the exhaust and gear box components of the power drive assembly.

With the adapter and mounting plate partially installed, a gear box assembly having appropriate gear ratios is raised upwardly through the elongated openings 27 or 27' in one end of the adapter and mounting plate until the input drive shaft thereof is engaged in sealed and driven relationship with the output of the engine crankshaft. Thereafter, the gear box mounting bolts are inserted through the flanges on the side of the gear box housing and the housing secured to the adapter and mounting plate and engine block.

Subsequently, the tuned exhaust expansion assembly 23 is raised into aligned position with the exhaust openings in the adapter and mounting plate and, using proper gasketing materials, the flange 41 of the exhaust system is secured into abutting relationship with the bottom of the adapter and mounting plate. Due to the offset nature of the muffler with respect to the mounting portion of the exhaust assembly, the muffler and tailpipe will be oriented generally in line with the drive train and offset with respect thereto. In order to provide coolant from the engine to the exhaust expansion assembly, the conduit 56 is connected to the fluid discharge opening 38 or 38' in the adapter and mounting plate and to the inlet 57 for the cooling jackets 53 and 54.

The engine power head is subsequently mounted to the mounting base or bracket assembly 25 by bolting the adapter and mounting plate thereto. Thereafter, the propulsion unit 60 is secured to the brackets 70 and is thereby properly aligned with the output shaft of the gear box. A drive connection is made between the gear box and the input shaft of the jet pump or other propulsion unit thereby completing the drive assembly from the engine to the propulsion unit. With the components assembled, the water inlet line is connected through the openings in the side walls of the adapter and mounting plate so that during the operation of the engine, water may be pumped upwardly through the inlet line 75 through passage 37 or 37' in the adapter and mounting plate into the engine and thereafter discharged to the expansion exhaust assembly. The engine and entire power drive assembly may now be readily installed within the boat as a unit with all the components thereof being supported by the base or frame 25. The base is thereafter secured to the hull of the boat with the tail pipe and thrust nozzle 82 of the propulsion unit extending through the transom or stern wall. Appropriate linkage connections L are thereafter made between the steering mechanism M and the propulsion nozzle 82 to thereby provide steering control for the boat.

I claim:

1. A power drive assembly for converting an outboard motor used with small marine craft to a motor having a horizontal drive system wherein the outboard motor includes a power head having a standard removable adapter plate therein through which a crankshaft, cooling system and exhaust outlet are accessed and where mounting bolt holes are provided to secure the standard adapter plate to the bottom of the power head during conventional use wherein the improvement comprises an adapter and mounting plate for positioning in place of the standard adapter plate so as to be in substantially abutting relationship with the bottom of the power head, a said adapter and mounting plate having a plurality of mounting bolt openings therethrough which are in alignment with the mounting bolt holes in the power head, means for mounting aid adapter and mounting plate to the bottom of the power head so as to be in fluid tight engagement therewith, a first opening in said adapter and mounting plate adjacent one end thereof, said first opening being generally aligned with the crankshaft when said adapter and mounting plate is mounted to the power head, an exhaust opening through said adapter and mounting plate in spaced relationship with respect to said first opening, said exhaust opening being in alignment with the exhaust outlet of the power head when said adapter and mounting plate is secured to the power head, a gear box means mounted to said adapter and mounting plate and having an input drive shaft extending through said first opening so as to be drivingly connected to the crankshaft, said gear box means having a power output shaft disposed generally perpendicularly to the input shaft, an exhaust assembly, means for mounting said exhaust assembly in aligned relationship with said exhaust opening in said adapter and mounting plate, a propulsion means, means for drivingly connecting said output shaft of said gear box means to said propulsion means and means for supporting said propulsion means relative to said gear box means.

2. The power drive assembly of claim 1 in which said adapter and mounting plate includes upper and lower surfaes, a recessed area in said upper surface thereof, said recessed area in said upper surface thereof communicating with the cooling system of the power head, at least one cooling fluid inlet opening extending through said adapter and mounting plate so as to communicate with said recessed area thereof and means for supplying a cooling fluid to said at least one cooling fluid opening.

3. The power drive assembly of claim 2 including a cooling fluid, fluid outlet opening, and outlet opening extenidng generally between said upper and lower surfaces of said adapter and mounting plate so as to be in fluid communication with said recessed area and first conduit means for supplying a cooling fluid to said cooling fluid inlet opening and second conduit means for conveying cooling fluid from said cooling fluid outlet opening.

4. The power drive assembly of claim 1 in which said means for supporting said propulsion means relative to said gear box means includes a mounting bracket assembly, first mean for securing said mounting bracket assembly within the marine craft and second means for securing said adapter and mounting plate to said mounting bracket assembly to thereby mount the power head within the marine craft.

5. The power drive assembly of claim 4 in which said mounting bracket assembly includes first and second portions which extend downwardly on opposite sides of said gear box means, support means extending from said first and second portions rearwardly of said gear box means, and means for securing said propulsion means to said support means of said mounting bracket assembly.

6. The power drive assembly of claim 5 in which said propulsion means is a jet pump means having a power input shaft, coupling means connecting said power input shaft of said jet pump means with said power output shaft of said gear box means.

7. The power drive assembly of claim 1 in which said adapter and mounting plate includes upper and lower surfaces, recessed areas within said upper surface of said adapter and mounting plate and communicating with the cooling system of the power head, a fluid inlet and fluid outlet opening through said adapter and mounting plate for channeling cooling fluid with respect to the power head, and first conduit means for connecting said fluid inlet opening with said propulsion means whereby water is conveyed from said propulsion means to the power head.

8. The power drive assembly of claim 7 in which said exhaust assembly includes a mounting portion and a muffler, an intermediate duct member connecting said muffler to said mounting portion, said muffler being oriented generally perpendicularly with respect to said mounting portion and being offset with respect thereto, and an exhasut pipe means extending from said muffler.

9. The power drive assembly of claim 8 in which said intermediate duct member and saids muffler have inner and outer wall portion forming first and second cooling jackets therebetween which are in open fluid communication with one another, a fluid inlet opening into said intermediate duct member so as to communicate with said first cooling jacket, second fluid conduit measn extending from said fluid outlet opening in said adapter and mounting plate to said fluid inlet opening into said intermediate duct member whereby cooling fluid is supplied from the power head to the exhasut assembly.

10. The power drive assembly of claim 9 including spray openings in said exhaust pipe means which communicate with said second cooling jacket for said muffler so that cooling fluid passing through said muffler will pass through said spray openings and into said exhaust pipe means.

11. The power drive assembly of claim 1 in which said adapter and mounting plate includes upper and lowr surfaces, sadi gear box means including a housing, said housing having a pair of outwardly extending flange portions on either side thereof, openings through each of said flange portions, aligned openings in said lower surface of said adapter and mounting plate and mounting means extending through said openings in said flange portions and said aligned openings to secure said gear box means to said adapter and mounting plate.

12. The power drive assembly of claim 11 in which said adapter and mounting plate includes an undercut portion in said lower surface thereof and adjacent to said first opening, said gear box means being seated within said undercut portion within the lower surface thereof with said input shaft thereof extending through said first opening.

13. The power drive asembly of claim 11 in which said exhaust opening is tapered in configuration from said upper surface towared said lower surface of said adapter and mounting plate so that the cross sectional area of said exhaust opening adjacent said upper surface is substantially differnet from that of the cross sectional configuration thereof when taken adjacent to said lower surface.

14. The power drive assembly of claim 11 in which said housing of said gear box means includes first and second sections, and means for securing said first and second sections in sealed engagement with respect to one another about said input and ouput shafts.

15. A power drive assembly for converting conventional outboard engines from a vertical drive to a horizontal drive wherein the outoard engine includes a power head having a standard adapter plate which is removable to create an opening therein to expose the cooling system, crankshaft and exhaust outlet, the power drive assembly comprising an adapter and mounting plate having upper and lower surfaces and having a first opening therein which is generally aligned with the crankshaft of the power head and a second opening therein spaced from said first opening which is aligned with the exhaust outlet a portion of said upper surface being recessed to provide a liquid reservoir for cooling fluid passing through the power head, means for mounting said adapter and mounting plate so that the upper surface thereof is in sealed engagement with the power head, said adapter and mounting plate having a plurality of first mounting holes disposed in the lower surface thereof, a gear box means positionable proximate to said first opening in said adapter and mounting plate, said gear box means having a housing having outwardly extending flange members on either side thereof, mounting bolt openings through each of said flange members of said housing, means extending through said openings in said flange members and into said first mounting holes in said lower surface of said adapter and mounting plate to secure said housing thereto, sadi gear box means having a drive input shaft which is selectively extendable through said first opening in said adapter and mounting plate and engageable with the crankshaft of the power head nad a power output shaft which is disposed generally perpendicularly with respect to said drive input shaft, a pluraity of second mounting holes in said lower surface of said adjapter and mounting plate adjacent said second opening therethrough, an exhaust expansion assembly having a mounting portion engageable with said lower surface of said adapter and mounting plate so as to be in surrounding relationship with respect to said second opening therethrough, means for securing said mounting portion of said exhaust expansion assembly to said second mounting holes, third mounting holes in said adapter and mounting plate, base support means, means for connecting said base support means to said adapter and mounting plate within said third mounting holes, propulsion means carried by said base support means so as to be generally aligned with the axis of said power output shaft of said gear box means, and coupling means for connecting said power output shaft of said gear box means to said propulsion means.

16. The power drive assembly of claim 15 in which said exhaust expansion assembly includes a muffler means connected to said mounting portion and an exhaust pipe means extending from said muffler means, said muffler means and said exhaust pipe means being inclined downwardly away from said adapter and mounting plate, means for passing a cooling fluid in heat exhcange relationship with said muffler means, and means for introducing the cooling fluid into said exhaust pipe means.

17. The power drive assembly of claim 16 including a fluid discharge conduit extending from said adapter and mounting plate to said exhaust expansion assembly, said fluid discharge conduit communicating said liquid reservoir with said means for passing a cooling fluid in heat exchange relationship with aid muffler means.

18. The power drive assembly of claim 17 including inlet and discahrge fluid cooling passageways extending between said upper and lower surfaces of said adapter and mounting plate, at least one of said inlet and discharge fluid cooling passageways communicating with said liquid reservoir in said upper surface of said adapter and mounting plate, said fluid discharge conduit being connected to said discharge fluid cooling passageway and a fluid inlet line for communicating said inlet fluid cooling passageway to said propulsion means.

19. The power drive assemlby of claim 18 in which said propulsion means is a jet pump having a power input shaft, said coupling means connecting said power input shaft of said jet pump with said power output shaft of said gear box means.

20. A power drive assembly for converting an outboard motor used with small marine craft to a motor having a horizontal drive propulsion system wherein the outboard motor includes a power head having a standard removable adapter plate which exposes the exhaust outlet, cooling system and the crankshaft from the bottom of the power head, comprising an adapter and mounting plate for positioning in substantially abutting relationship with the bottom of the power head in place of the standard adapter plate, said adapter and mounting plate having upper and lower surfaces, means for mounting said adapter and mounting plate to the power head so as to be in fluid tight engagement therewith, a first opening in said adapter and mounting plate which is generally aligned with the crankshaft of the power head when said adapter and mounting plate is mounted to the power head, an exhaust opening through said adapter and mounting plate in spaced relationship with respect to said first opening, said exhaust opening being in alignment with the exhaust outlet of the power head when said adapter and mounting plate is mounted to the power head, a gear box means mounted to said adapter and mounting plate and having an input drive shaft extending through said first opening so as to be drivingly connected to the crankshaft, said gear box means having a power output shaft disposed generally perpendicularly to the input shaft, an exhaust assembly, means for mounting said exhaust assembly to said adapter and mounting plate in communication with said exhaust opening therein, and means for selectively mounting a propulsion means so as to be generally aligned with said power output shaft of said gear box means.

21. The power drive assembly of claim 20 in which said exhaust assembly includes a mounting portion, muffler means and an exhaust pipe, said muffler means having an outer enclosed wall portion through which a cooling fluid may pass, conduit means for supplying cooling fluid from the cooling system to said muffler means so that exhaust gases are cooled as they pass therethrough.

22. The power drive assembly of claim 21 including openings in said exhaust pipe adjacent said muffler means, said outer enclosed wall portion of said muffler means being in open communication with said openings in said exhaust pipe to thereby supply cooling fluid inwardly of said exhaust pipe.

23. The power drive assembly of claim 20 including a propulsion means, said propulsion means being a pump means having a power input shaft, coupling means connecting said power input shaft of said pump means with said power output shaft of said gear boxy means.

24. The power drive assembly of claim 23 in which said means for selectively mounting a propulsion means includes a mounting base, first means for securing said mounting base within the marine craft and second means for securing said adapter and mounting plate to said mounting base to thereby mount the power head within the marine craft.

25. The power drive assembly of claim 24 in which said mounting base includes first and second portions which extend downwardly on opposite sides of said gear box means, support means extending from said first and second portions rearwardly of said gear box means, and means for securing said propulsion means to said support means of said mounting base.

* * * * *